US006003738A

United States Patent [19]

Foster et al.

[11] Patent Number: 6,003,738

[45] Date of Patent: Dec. 21, 1999

[54] CHILD-RESISTANT ROTATING LOCK FOR MANUALLY OPERATED PUMP DISPENSER

[75] Inventors: Donald D. Foster, St. Charles; Philip L. Nelson, Ellisville, both of Mo.

[73] Assignee: Continental Sprayers International,Inc., St. Peters, Mo.

[21] Appl. No.: 08/998,793

[22] Filed: Dec. 29, 1997

[51] Int. Cl.[6] ..... B67D 5/33

[52] U.S. Cl. ..... 222/384; 222/153.13; 222/383.1

[58] Field of Search ..... 222/153.13, 284, 222/384, 383.1

[56] References Cited

U.S. PATENT DOCUMENTS

| | | | |
|---|---|---|---|
| 4,441,633 | 4/1984 | Bennett | 222/153 |
| 4,946,074 | 8/1990 | Grogan . | |
| 5,114,049 | 5/1992 | Knickerbocker . | |

*Primary Examiner*—Andres Kashnikow
*Assistant Examiner*—David Deal
*Attorney, Agent, or Firm*—Howell & Haferkamp, LC

[57] ABSTRACT

A child resistant lock for manually-operated pump dispensers such as trigger sprayers, prevents movement of the trigger and reciprocation of the sprayer pump element when the lock is engaged.

20 Claims, 3 Drawing Sheets

CHILD-RESISTANT ROTATING LOCK FOR MANUALLY OPERATED PUMP DISPENSER

BACKGROUND OF THE INVENTION (1) Field of the invention

The present invention relates generally to a lock for manually-operated pump dispensers such as trigger sprayers, and more particularly to a lock that prevents movement of the trigger and reciprocation of the sprayer pump element when the lock is engaged.

(2) Description of Related Art

There are numerous prior art patents directed to child-resistant locking features used in fluid dispensers of the general type to which this invention relates. Generally a fluid dispenser of the type involved in the present invention is a relatively low-cost, hand-held trigger sprayer which may be manually operated by pulling a trigger to pump liquid from a container attached to the sprayer through a nozzle orifice at the front of the sprayer. Fluid dispensers of this type have a variety of features which have become well-known in the industry. For example, the dispenser may have a dedicated spray nozzle which produces a fixed spray pattern such as a narrow stream or a fine mist. Alternately, the fluid dispenser may be of the type which has a variable spray pattern. Still other fluid dispensers permit a foaming liquid to be dispensed as either a foam or a liquid spray. The child-resistant lock of the present invention is equally well-suited for use in each of these types of fluid dispensers, as well as, virtually any other type of fluid dispenser.

Regardless of the type of fluid dispenser used, the fluids dispensed could be chemicals which are harmful or fatal if swallowed. Further, the chemicals could be caustic and thus are harmful to individuals if they come in contact with the skin for any appreciable length of time. These harmful effects are frequently more pronounced in children because of their relatively small size and sensitive tissues. In addition, because children may not be able to read or understand textual or graphical warnings printed on the containers, they may not be able to appreciate the danger associated with the chemicals and thus have an increased risk of coming in contact with and being injured by these chemicals.

Although children may be more susceptible to being injured by chemicals dispensed from trigger sprayers, they are easier to protect from the harmful effects of the chemicals by physically locking the containers. Children may be prevented from accessing chemicals contained in a trigger sprayer by incorporating a lock on the trigger sprayer. Simply by requiring disengagement of a lock mechanism on a trigger sprayer before the trigger can be operated, a significant number of children may be prevented from dispensing fluid from the sprayer and others may be inhibited from dispensing fluid from the sprayer for a sufficient length of time so that an adult may be alerted to the potentially harmful acts of the child and take appropriate action.

In the past, various types of locking mechanisms have been developed for sprayers to impede children from coming into contact with potentially harmful chemicals dispensed by locking the trigger and pump elements of the sprayer against movement. One example is disclosed in U.S. Pat. No. 5,114,049. This reference discloses a latch which is pivotally connected to a trigger. The trigger is connected to the housing for pivoting movement in actuating a pump to dispense a liquid from the dispenser. When in the "on" position, the latch prevents the trigger from pivoting.

However, the latch is flexible and may be deflected from the "on" position so that the latch does not interfere with pivoting the trigger. Thus, when the latch is deflected to the "off" position, the trigger may be actuated and the fluid may be dispensed from the fluid dispenser. Therefore, the user must use one motion to deflect the latch upward or downward and a second motion to actuate the trigger backward and forward in order to dispense liquid. However, these two motions may be accomplished with one hand. By grasping the fluid dispenser in one hand, the latch may be disengaged with the index finger while the trigger is actuated with the remaining three fingers of the hand. Therefore, with a simple grasping motion, the latch may be unintentionally disengaged and the fluid may be dispensed. Also, in order to repeatedly pivot the trigger it is necessary to continue to hold the latch in its "off" position.

It would be desirable in a trigger sprayer having a lock that prevents the reciprocating movement of the pump element and the pivoting movement of the trigger, to position the lock on the sprayer so that it could not be inadvertently disengaged by simply grasping the sprayer and positioning the fingers of the hand over the trigger, and to construct the lock mechanism so that it would remain in its disengaged condition without the need to hold the lock in its disengaged condition while manipulating the trigger of the sprayer.

SUMMARY OF THE INVENTION

The present invention provides a locking mechanism for a trigger sprayer that does not require any significant change to the construction of the trigger sprayer in order to add the locking mechanism. The locking mechanism is designed to be used on a trigger sprayer of the type generally comprising a sprayer housing containing a pump chamber, a liquid discharge passage, and a liquid supply passage. A dip tube extends from the liquid supply passage into a liquid container to which the trigger sprayer is attached. The dip tube and the liquid supply passage provide fluid communication between the interior of the liquid container and the sprayer housing pump chamber. The sprayer housing pump chamber is also connected in liquid communication with the liquid discharge passage.

A pump element is mounted on the pump chamber for reciprocating movement relative thereto. The pump element may be a pump piston, or alternatively, could be a resilient, compressible bulb that is employed as a pump element on many prior art trigger sprayers. In addition, the locking mechanism may also be used on a trigger sprayer having a pump piston with an arm extending a vent piston into a vent chamber of the sprayer housing.

A nozzle assembly is assembled to the liquid discharge passage of the sprayer housing. The nozzle assembly can be one which only dispenses liquid in a spray pattern, or could be one which has an adjustment to vary the liquid discharged between a spray and stream pattern, or could also be a nozzle assembly that generates foam as liquid is discharged through the assembly.

A trigger is mounted to the sprayer housing for pivoting movement. The trigger is operatively connected with the pump element to cause the pump element to reciprocate between charge and discharge positions relative to the pump chamber in response to pivoting movement of the trigger.

The locking mechanism of the invention is basically comprised of an abutment provided on the exterior surface of the trigger sprayer pump element, and a lock base that is mounted to the sprayer housing of the trigger sprayer for rotation through an arc segment relative to the trigger sprayer.

In the preferred embodiment, the pump element abutment is provided on one side of the pump element. The abutment is spaced from the sprayer housing on the pump element so that there is a spacing between the abutment and the pump chamber of the sprayer housing.

The lock base includes a circular collar that is mounted around the sprayer housing and fits loosely around the housing so that it can be rotated relative thereto without any appreciable effort. An arm projects upwardly from the collar to a topmost end of the arm that is positioned adjacent the pump element abutment. A handle projects radially outwardly and then downwardly from the collar beside the connector of the sprayer housing that attaches the housing to the liquid container.

By manipulation of the handle, the lock base collar can be rotated in opposite directions around the sprayer housing. The rotation of the collar in turn causes the topmost end of the arm to move between an engaged position where it is positioned between the pump element abutment and the pump chamber of the sprayer housing, and a disengaged position where it is displaced from between the pump element abutment and the pump chamber. When the arm is positioned between the pump element abutment and the pump chamber, it prevents the pump element from being reciprocated into the pump chamber toward its discharge position. Thereby, the arm in its engaged position locks the pump element in its charge position relative to the pump chamber and sprayer housing and prevents reciprocating movement of the pump element into the pump chamber and, in turn, prevents pivoting movement of the trigger relative to the sprayer housing due to the operative connection between the trigger and the pump element. In order to operate the trigger and pump element, the handle projecting from the lock base is manipulated causing the collar of the base to rotate around the trigger sprayer and, in turn, causing the arm to move through an arc segment to a position where it is displaced from the spacing between the pump element abutment and the pump chamber. With the arm removed from its position between the abutment and the pump chamber, the trigger can then be manipulated causing the pump element to reciprocate between its charge and discharge positions which causes the pump to dispense liquid through the sprayer housing.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

Figure 2:
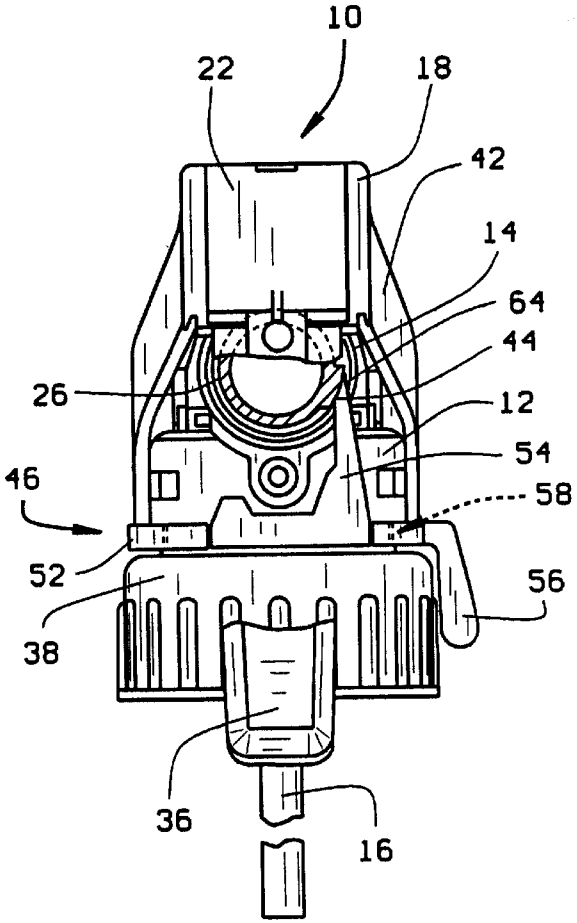
FIG. 2 shows a front elevation view of the trigger sprayer including the lock mechanism of the invention with a portion of the sprayer closure door and pump element removed to better show the lock mechanism of the invention.
Figure 1:
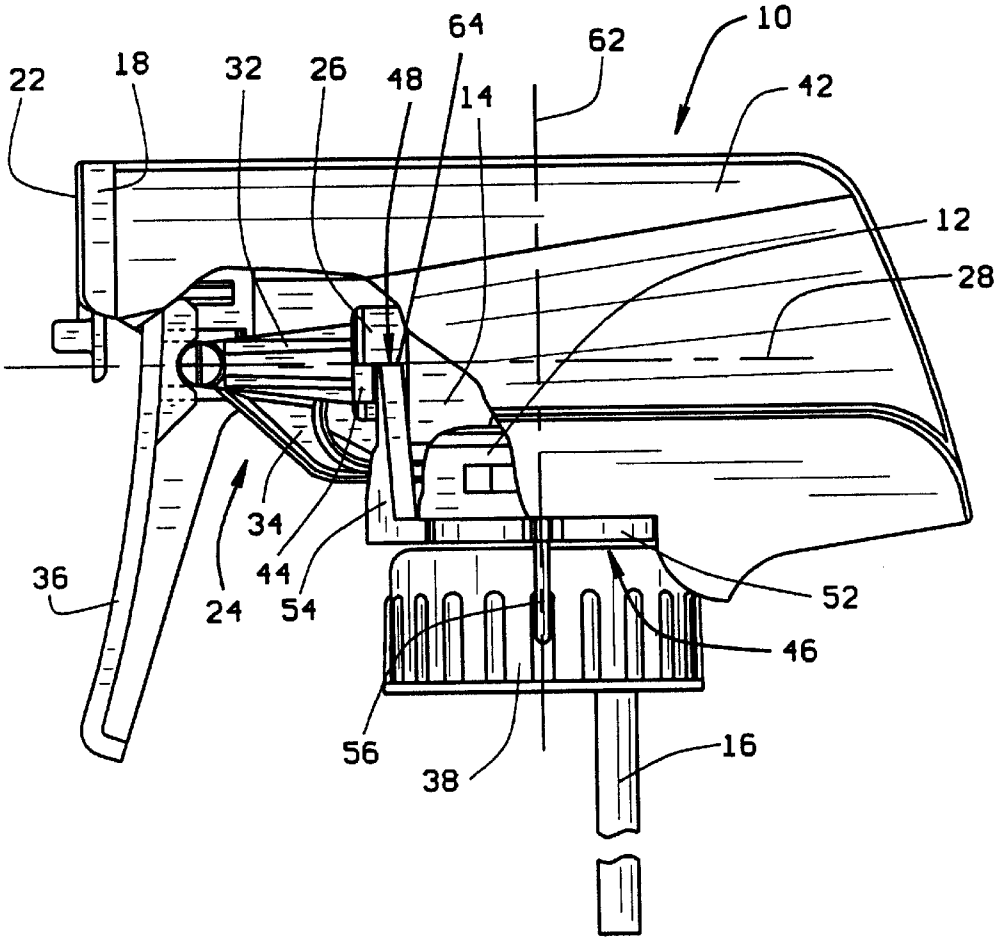
FIG. 1 shows a side elevation view of a trigger sprayer employing the lock mechanism of the invention with a portion of the sprayer shroud removed to reveal the lock mechanism.

FIGS. 1 and 2 show a side and front view, respectively, of a trigger sprayer incorporating the lock mechanism of the invention. The trigger sprayer shown is comprised of component parts that are common to many prior art trigger sprayers such as those disclosed in U.S. Pat. No. 4,958,754 of Dennis et al.; U.S. Pat. No. 5,294,025 of Foster; U.S. Pat. No. 5,337,928 of Foster et al.; U.S. Pat. No. 5,344,053 of Foster et al.; U.S. Pat. No. 5,462,209 of Foster et al.; U.S. Pat. No. 5,467,901 of Foster et al.; and U.S. Pat. No. 5,540,360 of Foster et al. Because each of these patents disclose the construction and operation of a typical trigger sprayer, the component parts of the trigger sprayer will only be disclosed generally here.

The trigger sprayer 10 includes a sprayer housing 12 that contains a pump chamber 14. The sprayer housing also contains a liquid discharge passage and liquid supply passage (not shown). A dip tube 16 extends downwardly from the liquid supply passage into a liquid container when the trigger sprayer is attached to the neck of the liquid container. The dip tube 16 and liquid supply passage provide fluid communication between the interior of the liquid container and the sprayer housing pump chamber 14. The sprayer housing pump chamber is also connected in liquid communication with the liquid discharge passage. A priming valve (not shown) is provided in the fluid path between the dip tube 16 and the pump chamber 14, and a check valve (not shown) is provided in the fluid path between the pump chamber and the liquid discharge passage.

A nozzle assembly 18 is mounted on the sprayer housing 12 and communicates with the liquid discharge passage. The nozzle assembly 18 has a door closure 22 shown in its closed position. The door closure 22 covers over a discharge orifice (not shown) of the nozzle assembly through which liquid is dispensed from the trigger sprayer. The nozzle assembly 18 shown is only one type of nozzle assembly commonly employed on trigger sprayers. The trigger sprayer 10 could have a nozzle assembly that dispenses liquid in a spray pattern, in a stream pattern, or as a foam, or could be an adjustable nozzle assembly that varies the manner in which the liquid is dispensed from the trigger sprayer. It should be understood that referring to the trigger sprayer is not intended as a limitation to that type of sprayer that only discharges liquid in a spray pattern. The lock mechanism of the invention to be described may be used with a variety of different types of trigger sprayers that dispense liquid in various forms.

A pump element 24 is mounted on the pump chamber 14 for reciprocating movement relative thereto. The particular pump element shown is comprised of a piston 26 that is slidably received in the pump chamber 14 for reciprocating movement relative along a first axis 28. However, the lock mechanism of the invention may be used with other types of pump elements for example a resilient, compressible bulb that is employed as a pump element on many prior art trigger sprayers. On the pump element shown, the piston 26 is connected to a piston rod 32 that projects forwardly from the piston. An arm 34 extends downwardly from the piston rod 32 and then beneath the pump chamber 14 of the sprayer to a vent piston (not shown) at the distal end of the arm. The vent piston is contained in a vent chamber (not shown) of the sprayer housing 12 which operates to vent the liquid container attached to the trigger sprayer as is known in the art.

A trigger 36 is mounted to the trigger sprayer housing 12 for pivoting movement. The trigger 36 is operatively connected to the piston rod 32 of the pump element to cause the pump element to reciprocate between charge and discharge positions of the piston 26 in the pump chamber 14 in response to pivoting movement of the trigger. Alternatively, the trigger 36 could be mounted to the sprayer housing 12 in some other fashion other than for pivoting movement provided that it is operatively connected to the pump element 24 to reciprocate the pump piston 26 in the pump chamber 14 between its charge and discharge positions. The trigger 36 pushes the pump piston 26 into the pump chamber 14 when moving the pump piston to its discharge position, and a return spring (not shown) in the pump chamber 14 pushes the piston 26 out of the pump chamber to move the piston to its charge position. When the piston is moved to its discharge position, it pumps liquid through the discharge passage of the trigger sprayer dispensing the liquid through the nozzle assembly 18. When the pump piston is moved to its charge position, it creates a suction in the pump chamber 14 drawing liquid through the dip tube 16 and the supply passage into the pump chamber. This pumping operation is substantially the same in many prior art trigger sprayers.

The sprayer housing 12 is provided with a cap closure 38 on the bottom of the housing. For the particular trigger sprayer shown, the cap closure 38 is mounted on the bottom of the sprayer housing 12 to permit rotation of the cap relative to the housing. The cap closure 38 is the type that can be screw threaded onto mating threads of a bottle container neck. As an alternative to the cap closure 38 shown, the sprayer housing 12 could also be provided with a bayonet-type connector formed integrally with the sprayer housing. The bayonet-type connector is also known in the art and can be snap-fit onto a mating connector on a bottle container neck.

A shroud or cover 42 is attached over the sprayer housing 12 and covers many of the component parts of the trigger sprayer. The shroud 42 is primarily employed to give the trigger sprayer an aesthetically pleasing appearance. As shown in FIG. 1, a portion of the shroud 42 is removed in order to provide a view of the component parts of the trigger sprayer discussed above. In FIG. 2, portions of the door closure 22, trigger 36 and pump element 24 are removed to provide a better view of the lock mechanism of the invention.

The lock mechanism of the invention is basically comprised of an abutment 44 provided on the exterior surface of the pump element 24 and a lock base 46 mounted on the sprayer housing 12.

The abutment 44 is formed as an integral part of the pump element 24. As seen in FIG. 1, the abutment 44 is provided on a side of the exterior surface of the pump piston 26. The abutment 44 is positioned forwardly on the pump piston 26 where it will not interfere with the reciprocating movement of the pump piston in the pump chamber 14. This positioning of the abutment provides a spacing 48 between the abutment 44 and the forward edge of the pump chamber 14. As seen in FIG. 2, the abutment 44 projects a short distance radially outwardly from the exterior surface of the piston 26.

Figure 3:
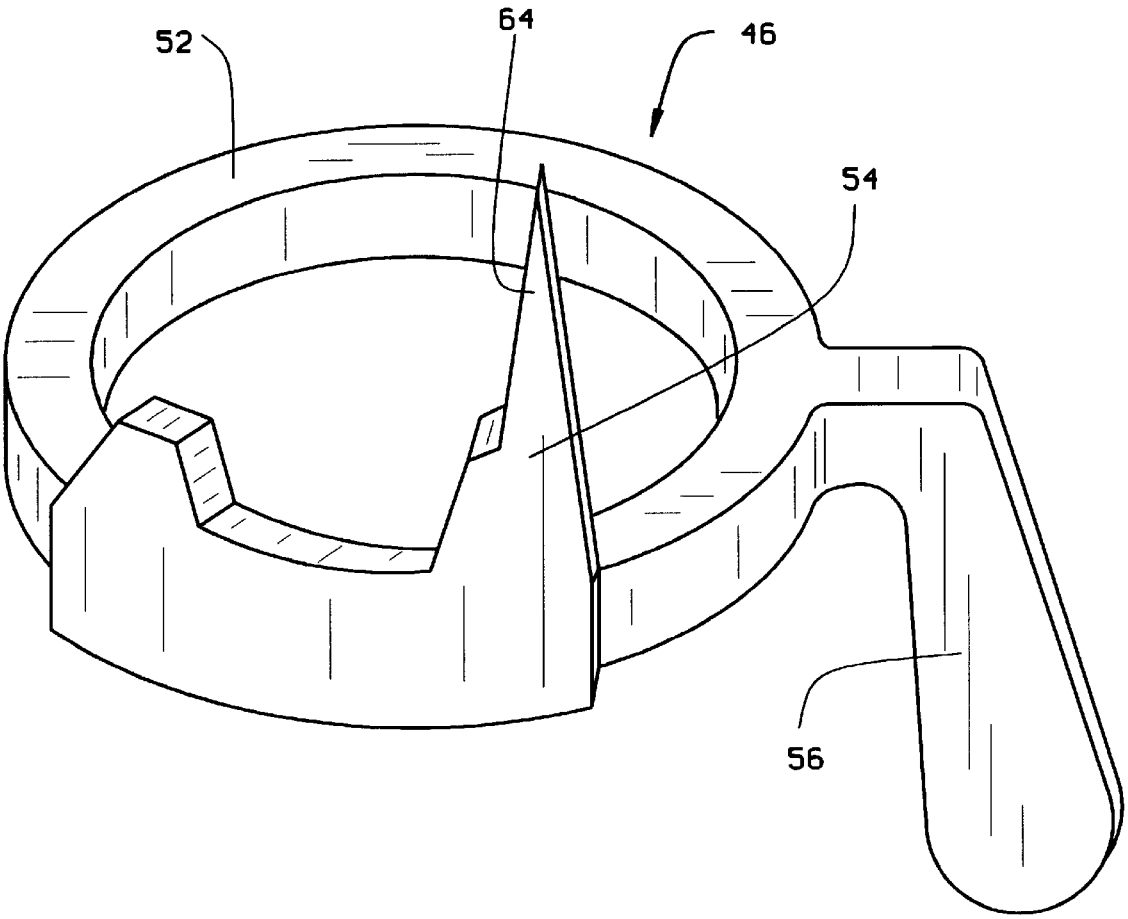
FIG. 3 is a perspective view of the lock mechanism removed from the sprayer housing.

The lock base 46 of the locking mechanism is shown removed from the sprayer housing 12 in FIG. 3. The lock base is basically comprised of an annular collar 52, an arm 54 projecting upwardly from the collar and a handle 56 projecting downwardly from the collar. The annular collar, arm and handle of the lock base 46 are all molded as an integral unit.

As seen in FIGS. 1 and 2, the annular collar is dimensioned to fit around the sprayer housing 12 where an annular groove 58 is formed in the housing. With the annular collar 52 positioned in the groove 58, a portion of the sprayer housing projects over the top of the collar and the collar itself rests on top of the cap closure 38. The collar 52 is mounted on the sprayer housing for a friction fit that provides sufficient resistance to rotational movement of the collar around the housing to hold the collar in an adjusted position on the housing, but the fit still permits the collar to be rotated around the housing with a minimal effort. In the arrangement of the collar on the housing shown in the drawings, the collar 52 has an axis of rotation 62 that is parallel and coaxial with a center axis or axis of rotation of the cap closure 38. However, it is not necessary that the collar axis of rotation 62 be coaxial with the axis of rotation of the cap closure 38. It could be seen that the annular collar 52 could be mounted on a sprayer housing 12 having a bayonet-type connector in place of the cap closure 38 where the axis of rotation of the collar 62 is displaced from but parallel to a center axis of the bayonet-type closure.

The arm 54 projects upwardly from the collar 52 in a direction along side the center axis or axis of rotation of the collar 62. The arm extends to its topmost end 64 that is positioned adjacent the abutment 44 on the pump piston 26. As seen in FIG. 1, the arm at its topmost end 64 has a width dimension that enables it to be positioned between the abutment 44 on the pump piston 26 and the forward edge of the pump chamber 14. In this position of the arm top end 64 it prevents movement of the abutment 44 toward the pump chamber 14 and thereby prevents reciprocating movement of the pump piston 26 and pivoting movement of the trigger 36.

The handle 56 projects downwardly from the side of the annular collar 52 in a direction along side the center axis or axis of rotation 62 of the collar. This positions the handle 56 along side a portion of the cap closure 38 as shown in the drawings. In FIGS. 1–3, the handle 56 is positioned at about one-quarter of the circumference of the annular collar 52 from the arm 54.

With the construction of the lock base 46 described above and its mounting on the sprayer housing 12, by manipulation of the handle 56, the lock base can be rotated in opposite directions around the sprayer housing. The rotation of the annular collar 52 in turn causes the topmost end 64 of the arm to move between an engaged position where it is positioned between the pump element abutment 44 and the pump chamber 14 of the sprayer housing, and a disengaged position where it is displaced from the space 48 between the pump element abutment 44 and the pump chamber 14. When the arm 54 is positioned between the pump element abutment 44 and the pump chamber 14, it prevents the pump element from being reciprocated into the pump chamber toward its discharge position. Whereby, the arm in its engaged position locks the pump element 24 in its charge position relative to the pump chamber 14 and sprayer housing 10 and prevents reciprocating movement of the pump element into the pump chamber and, in turn, prevents pivoting movement of the trigger relative to the sprayer housing due to the operative connection between the trigger and the pump element. In order to operate the trigger 36 and the pump element 24, the handle 56 projecting from the annular collar 52 is manipulated causing the collar to rotate around the sprayer housing 12 and, in turn, causing the arm to move through an arc segment to a position where it is displaced from the spacing 48 between the pump element abutment 44 and the pump chamber 14. With the arm removed from its position between the abutment and the pump chamber, the trigger 36 can then be manipulated causing the pump element 24 to reciprocate between its charge and discharge positions which causes the pump to dispense liquid through the sprayer housing.

Figure 5:
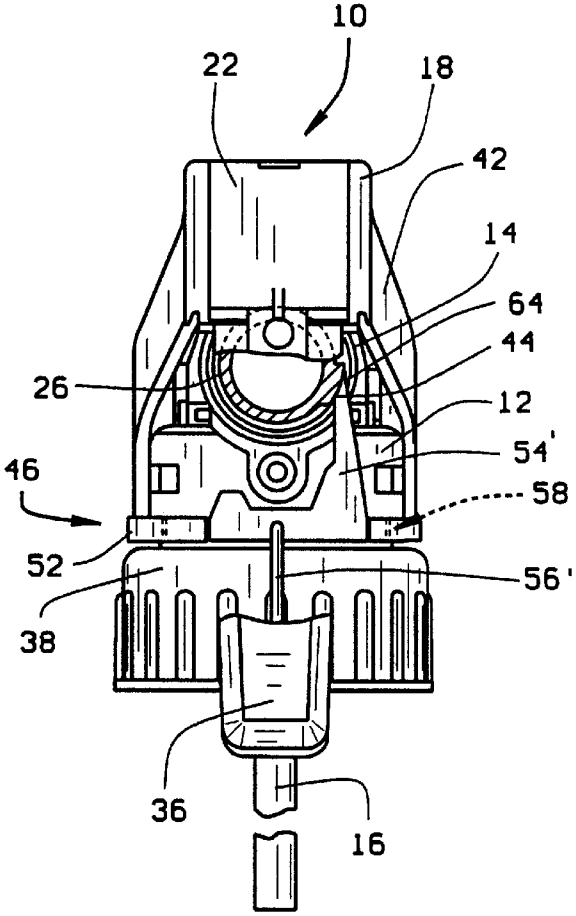
FIGS. 4 and 5 are similar to those of FIGS. 1 and 2 showing a variant embodiment of the lock mechanism.
Figure 4:
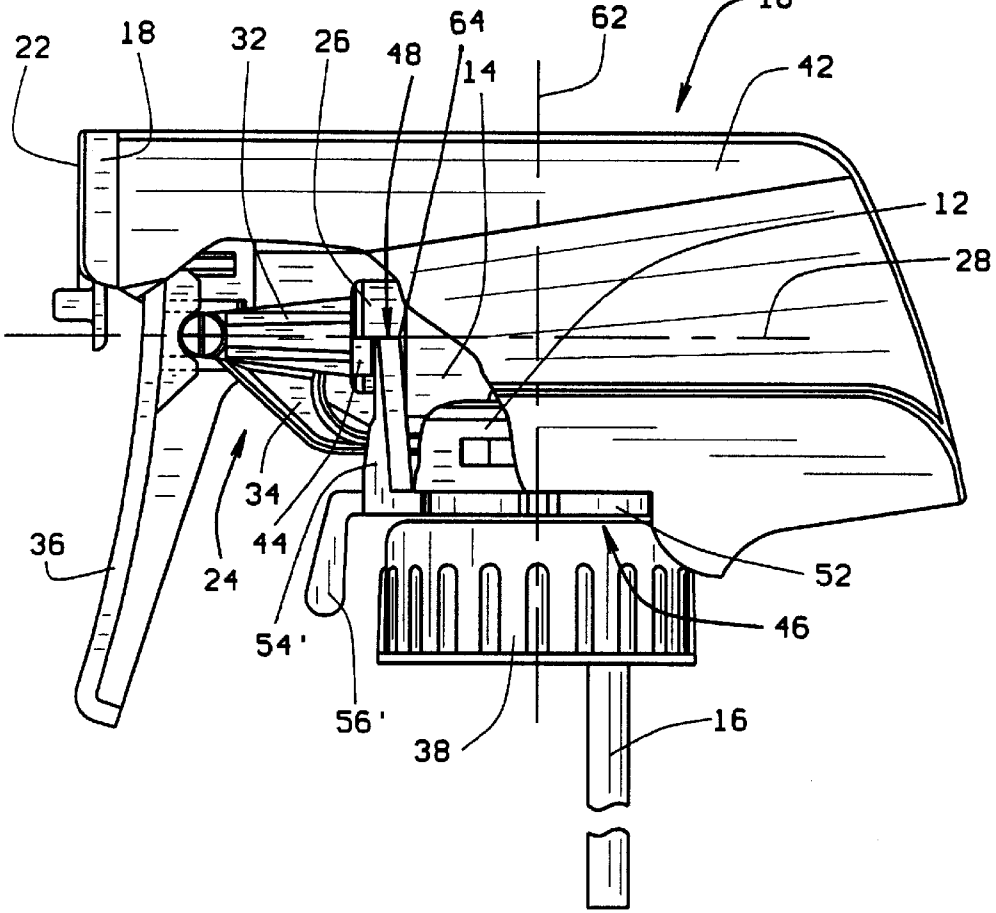

FIGS. 4 and 5 disclose a variant embodiment of the lock mechanism of the invention with like component parts to the first described embodiment having the same reference numerals followed by a prime (′). The only difference in this embodiment from the previously described embodiment is that the handle 56′ is positioned adjacent the arm 54′. With this positioning of the handle 56′, it is possible to manipulate the handle to move the arm 54′ between its engaged and disengaged positions relative to the pump element 24 and pump chamber 14 with the same hand used to manipulate the trigger 36 in dispensing liquid from the trigger sprayer.

The construction of the lock mechanism described above provides a child-resistent lock that can be moved from its engaged position to its disengaged position where it will remain in its disengaged position while the trigger is manipulated without the need to hold the lock mechanism in its disengaged position. Also, because the lock mechanism is positioned on the sprayer housing away from the trigger, the problem of unintentionally disengaging the lock mechanism by simply grasping the trigger is avoided.

While the present invention has been described by reference to a specific embodiment, it should be understood that modifications, and variations of the invention may be constructed without departing from the scope of the invention defined in the following claims.

What is claimed is:

1. A locking trigger sprayer comprising:

a sprayer housing;

a pump chamber on the sprayer housing;

a pump element mounted on the pump chamber for reciprocating movement along a first axis between charge and discharge positions of the pump element relative to the pump chamber, the pump element having an abutment;

a trigger mounted on the sprayer housing for movement relative to the sprayer housing, the trigger being operatively connected to the pump element to reciprocate the pump element between its charge and discharge positions in response to movement of the trigger;

a lock base mounted on the sprayer housing for movement of the lock base around a second axis, different from the first axis, between engage and disengage positions of the lock base relative to the sprayer housing, where in the engage position a portion of the lock base is positioned adjacent the pump element abutment where it will engage with the abutment when the pump element is moved from the charge position toward the discharge position and thereby prevent the pump element from moving between its charge and discharge positions, and in the disengage position the portion of the lock base is displaced from the pump element abutment and permits moving the pump element between its charge and discharge positions.

2. The locking trigger sprayer of claim 1, wherein:

the lock base has a circular collar that extends around the sprayer housing and thereby mounts the lock base on the sprayer housing for movement of the lock base around the second axis.

3. The locking trigger sprayer of claim 2, wherein:

the circular collar has an axis of rotation that is parallel with the second axis.

4. The locking trigger sprayer of claim 2, wherein:

the portion of the lock base is an arm that projects outwardly from the collar in a direction alongside the second axis.

5. The locking trigger sprayer of claim 4, wherein:

the lock base has a handle that projects outwardly from the collar in a direction opposite to that of the arm.

6. The locking trigger sprayer of claim 4, wherein:

the pump element is a piston mounted on the pump chamber for reciprocating movement in the pump chamber, the pump element abutment is on an exterior surface of the piston, and the arm of the lock base projects between the abutment and the pump chamber when the lock base is in its engage position and the arm is displaced from between the abutment and the pump chamber when the lock base is in its disengage position.

7. The locking trigger sprayer of claim 1, wherein:

the sprayer housing has a connector adapted to attach the sprayer housing to a bottle container, and the connector has a center axis that is parallel to the second axis.

8. The locking trigger sprayer of claim 1, wherein:

the pump element is a piston mounted on the pump chamber for reciprocating movement in the pump chamber, the pump element abutment is on an exterior surface of the piston, and the portion of the lock base is positioned between the abutment and the pump chamber when the lock base is in its engage position and the portion of the lock base is displaced from between the abutment and the pump chamber when the lock base is in its disengage position.

9. A locking trigger sprayer comprising:

a sprayer housing;

a pump chamber on the sprayer housing;

a pump element mounted on the pump chamber for reciprocating movement between charge and discharge positions of the pump element relative to the pump chamber, the pump element having an abutment;

a trigger mounted on the sprayer housing for movement relative to the sprayer housing, the trigger being operatively connected to the pump element to reciprocate the pump element between its charge and discharge positions in response to movement of the trigger;

a lock base mounted on the sprayer housing for movement of the lock base around an axis of rotation between engage and disengage positions of the lock base relative to the sprayer housing, and an arm projecting outwardly from the lock base in a direction alongside the lock base axis of rotation where the arm is positioned adjacent the pump element abutment where it will engage with the abutment when the pump element is moved from the charge position toward the discharge position and thereby prevent the pump element from moving between its charge and discharge positions when the lock base is in its engage position, and the arm is displaced from the pump element abutment and permits the pump element to move between its charge and discharge positions when the lock base is in its disengage position.

10. The locking trigger sprayer of claim 9, wherein:

the lock base has a circular collar that extends around the sprayer housing and thereby mounts the lock base on the sprayer housing for movement of the lock base around the lock base axis of rotation.

11. The locking trigger sprayer of claim 9, wherein:

the pump element is mounted on the pump chamber for reciprocating movement along a pump element axis that is oriented at an angle relative to the lock base axis of rotation.

12. The locking trigger sprayer of claim 9, wherein:

the sprayer housing has a connector adapted to attach the sprayer housing to a bottle container, and the connector has a center axis that is parallel to the lock base axis of rotation.

13. The locking trigger sprayer of claim 9, wherein:

the lock base has a handle that projects outwardly from the lock base in a direction opposite that of the arm.

14. The locking trigger sprayer of claim 9, wherein:

the pump element is a piston mounted on the pump chamber for reciprocating movement in the pump chamber, the pump element abutment is on an exterior surface of the piston, and the arm of the lock base projects between the abutment and the pump chamber when the lock base is in its engage position and the arm is displaced from between the abutment and the pump chamber when the lock base is in its disengage position.

15. A locking trigger sprayer comprising:

a sprayer housing;

a pump chamber on the sprayer housing;

a pump element mounted on the pump chamber for reciprocating movement between charge and discharge positions of the pump element relative to the pump chamber, the pump element having an abutment;

a trigger mounted on the sprayer housing for movement relative to the sprayer housing, the trigger being operatively connected to the pump element to reciprocate the pump element between its charge and discharge positions in response to movement of the trigger;

a lock base mounted on the sprayer housing for movement of the lock base around an axis of rotation between engage and disengage positions of the lock base relative to the sprayer housing, where in the engage position a portion of the lock base is positioned between the pump element abutment and the pump chamber and prevents the pump element from moving between its charge and discharge positions, and in the disengage position the portion of the lock base is displaced from between the pump element abutment and the pump chamber and permits moving the pump element between its charge and discharge positions.

16. The locking trigger sprayer of claim 15, wherein:

when in the engage position the portion of the lock base positioned between the pump element abutment and the pump chamber will engage with the abutment when the pump element is moved from the charge position toward the discharge position and thereby prevent the pump element from moving between its charge and discharge positions.

17. The locking trigger sprayer of claim 15, wherein:

the portion of the lock base is an arm that projects from the lock base in a direction alongside the lock base axis of rotation.

18. The locking trigger sprayer of claim 17, wherein:

the lock base has a handle that projects outwardly from the collar in a direction opposite to that of the arm.

19. The locking trigger sprayer of claim 15, wherein:

the lock base has a circular collar that extends around the sprayer housing and thereby mounts the lock base on the sprayer housing for movement of the lock base around the lock base axis of rotation.

20. The locking trigger of claim 15, wherein:

the pump element is mounted on the pump chamber for reciprocating movement along a pump element axis that is oriented at an angle relative to the lock base axis of rotation.

* * * * *